United States Patent [19]

Buchanan et al.

[11] Patent Number: 4,927,431

[45] Date of Patent: May 22, 1990

[54] BINDER FOR COATED ABRASIVES

[75] Inventors: Scott Buchanan; Eric G. Larson; Jon R. Pieper; Thomas E. Boettcher, all of St. Paul, Minn.

[73] Assignee: Minnesota Mining and Manufacturing Company, St. Paul, Minn.

[21] Appl. No.: 241,946

[22] Filed: Sep. 8, 1988

[51] Int. Cl.[5] ..... C09K 3/14

[52] U.S. Cl. ..... 51/298; 51/295; 51/308; 51/309; 427/44; 526/261

[58] Field of Search ..... 51/295, 298, 308, 309; 427/44; 526/261

[56] References Cited

U.S. PATENT DOCUMENTS

| | | | |
|---|---|---|---|
| 4,047,903 | 9/1977 | Hesse et al. | 51/298 R |
| 4,345,545 | 8/1982 | Miller | 118/621 |
| 4,457,766 | 7/1984 | Caul | 51/298 |
| 4,547,204 | 10/1985 | Caul | 51/298 |
| 4,588,419 | 5/1986 | Caul et al. | 51/295 |
| 4,642,126 | 2/1987 | Zador et al. | 51/295 |
| 4,644,703 | 2/1987 | Kaczmarek et al. | 51/298 |
| 4,652,274 | 3/1987 | Boettcher et al. | 51/298 |

FOREIGN PATENT DOCUMENTS

| | | |
|---|---|---|
| 0115160 | 8/1984 | European Pat. Off. . |
| 1956810 | 7/1971 | Fed. Rep. of Germany . |
| 1509069 | 4/1978 | United Kingdom . |
| 2087263 | 5/1982 | United Kingdom . |

*Primary Examiner*—Paul Lieberman
*Assistant Examiner*—Willie J. Thompson
*Attorney, Agent, or Firm*—Donald M. Sell; Walter N. Kirn; David L. Weinstein

[57] ABSTRACT

An abrasive product comprising abrasive grains bonded to at least one major surface of a backing sheet by a binder formed from a blend comprising radiation curable monomer and a thermally curable resinous material. The radiation curable monomer can be selected from the group consisting of isocyanurate derivatives having at least one terminal or pendant acrylate group, isocyanate derivatives having at least one terminal or pendant acrylate group, and multifunctional acrylate monomers. The thermally curable resinous material is preferably a member selected from the group consisting of phenolic resins, urea-formaldehyde resins, melamine-formaldehyde resins, and epoxy resins. The binder can be used to form the make coat, size coat, both make and size coats, or as a backing treatment for a coated abrasive product. The binder can also be used in fibrous nonwoven abrasive products. The binder can also be used in embodiments where only a single-coat binder is employed.

24 Claims, 1 Drawing Sheet

BINDER FOR COATED ABRASIVES

BACKGROUND OF THE INVENTION

1. Field of the Invention

This invention relates to abrasive products having a resinous binder which bonds abrasive granules to a backing sheet or to a fibrous sheet.

2. Discussion of the Prior Art

Coated abrasives generally comprise a flexible backing to which an adhesive or adhesives bond a coating of abrasive granules. The backing may be paper, cloth, film, vulcanized fiber, etc., or a combination of one or more of these materials, or treated versions thereof. The abrasive granules may be formed of flint, garnet, aluminum oxide, alumina zirconia, ceramic aluminum oxide, diamond, silicon carbide, etc. Popular binders include phenolic resins, hide glue, urea-formaldehyde, urethanes, epoxies, and varnish. Phenolic resins include those of the phenolaldehyde type.

The coated abrasive may employ a "make" coat of resinous binder material which is utilized to secure the ends of the abrasive granules onto the backing sheet as the granules are oriented and a "size" coat of resinous binder material over the make coat which provides for firm adherent bonding of the abrasive granules to the backing sheet. The binder of the size coat may be of the same material as the binder of the make coat, or it may be of a different material.

In the manufacture of coated abrasives, the make coat and abrasive granules are first applied to the backing, the make coat is partially cured, then the size coat is applied, and finally, the construction is fully cured. Generally, thermally curable binders provide coated abrasives having excellent properties, e.g. heat resistance. Thermally curable binders include phenolic resins, urea-formaldehyde resins, urethane resins, melamine resins, epoxy resins, and alkyd resins. In order to obtain the proper coating viscosities, solvent is added to these resins. With polyester or cellulose backings, however, curing temperatures are limited to about 130° C. At this temperature, cure times are long. The long cure time along with the requirement of solvent removal necessitate the use of festoon curing areas. Disadvantages of festoon curing areas include the formation of defects at the suspension rods, inconsistent cure due to temperature variations in the large festoon ovens, sagging of the binder, wrinkling of very flexible webs, and shifting of abrasive granules. Furthermore, festoon curing areas require large amounts of space and enormous amounts of energy. If one could use a total drum thermal cure, i.e. wherein the coated abrasive is wound up in a roll or jumbo, and then placed in an oven, this would eliminate many of the problems associated with festoon curing. Drum curing does not require the use of a large oven; consequently, the amount of energy and space required is considerably less than with festoon ovens. However, it is not possible to use a drum cure by itself with the conventional thermally curable binders mentioned above, because the use of a festoon oven is initially required to remove the large quantities of solvent contained therein.

It has been proposed to use radiation curing processes to avoid the disadvantages of festoon ovens required in the manufacture of coated abrasives. U.S. Pat. No. 4,547,204 discloses the use of radiation curable acrylated epoxy resins in one adhesive layer of the coated abrasive and the use of a heat curable phenolic or acrylic latex resin in another adhesive layer of the coated abrasive. U.S. Pat. No. 4,588,419 discloses an adhesive for coated abrasives comprising a mixture of: (a) electron radiation curable resin system comprising an oligomer selected from the group consisting of urethane acrylates and epoxy acrylates, filler, and a diluent and (b) a heat curable resin selected from the group consisting of phenolic resins, melamine resins, amino resins, alkyd resins, and furan resins. U.S. Pat. No. 4,652,274 discloses a binder for coated abrasives, which can be cured by radiation energy, comprising a copolymer formed from an isocyanurate monomer having at least one pendant acrylate group and an aliphatic or cycloaliphatic monomer having at least one pendant acrylate group. U.S. Pat. No. 4,642,126 discloses a coated abrasive binder comprising diacrylated monomers, monofuctional monomers, acrylated oligomers, and a photoinitiator. U.S. Pat. No. 4,644,703 discloses a coated abrasive binder comprising diacrylated monomer, triacrylate monomers, and a photoinitiator. Although radiation curable binders solve the above-mentioned problems associated with thermally curable binders, with respect to a festoon oven, radiation curable binders generally are more expensive than thermally curable binders. In many abrasive products, this increase in cost cannot be tolerated; thus thermally curable resins are still utilized.

SUMMARY OF THE INVENTION

This invention provides a coated abrasive comprising a backing bearing abrasive grains or granules adhered thereto by a binder prepared from a blend comprising (1) at least one radiation curable monomer selected from the group consisting of (a) isocyanurate derivatives having at least one terminal or pendant acrylate group, (b) isocyanate derivatives having at least one terminal or pendant acrylate group, and (c) multifunctional acrylates, and (2) a thermally curable resin. The preferred thermally curable resin is selected from the group consisting of (a) phenolic resins, (b) epoxy resins, (c) acrylate resins, (d) urea-formaldehyde resins, (e) melamine-formaldehyde resins, and (f) polyimide resins. The preferred radiation curable monomers have a heterocyclic ring configuration, the preferred monomer being the reaction product of a mixture of acrylic acid or methacrylic acid with tris(hydroxyalkyl)isocyanurate. The preferred monomers of the multifunctional acrylate are triacrylate monomers. The preferred thermally curable resin is a phenolic resin, more preferably a resole phenolic resin. The preferred method for curing the aforementioned binder is to expose it to a source of conventional electromagnetic radiation, and then, at a later time, expose it to heat.

The invention eliminates problems known in the art associated with both radiation curable binders and thermally curable binders. Mixing the radiation curable binder with the thermally curable binder results in reducing the total cost of the binder and eliminating the need for a festoon curing oven. The performance of the coated abrasive of the present invention equals or exceeds that of coated abrasives formed with thermally curable phenolic resins only. The coated abrasive of this invention demonstrates improved grinding performance under severe conditions as compared with coated abrasives comprising radiation curable binders heretofore known.

DETAILED DESCRIPTION

Figure 2:
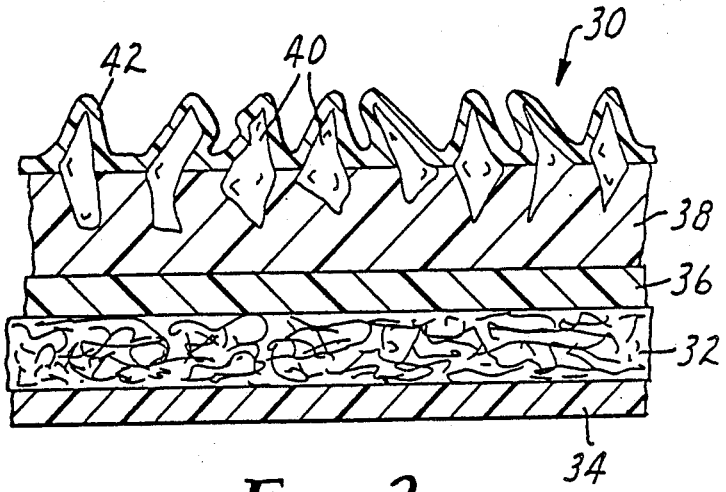
FIG. 2 illustrates in cross-section a coated abrasive on a paper backing material.
Figure 1:
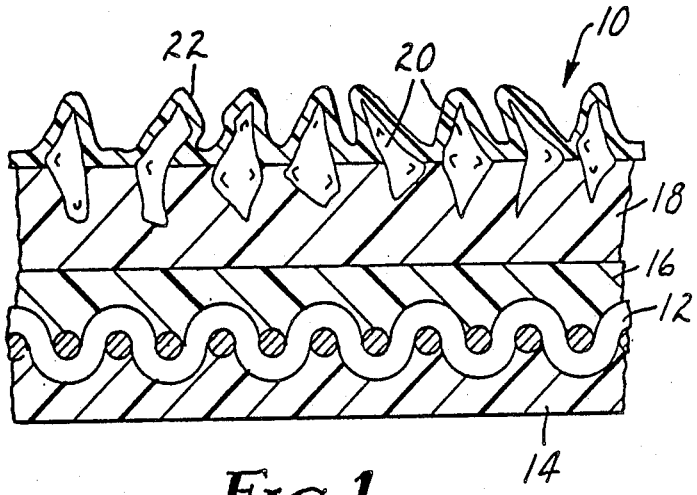
FIG. 1 illustrates in cross-section a coated abrasive on a cloth backing material.

Coated abrasives that may be produced by the binder systems of the present invention are illustrated in FIGS. 1 and 2. As illustrated in FIG. 1, the coated abrasive generally indicated as 10 is cloth backed. Cloth 12 has been treated with an optional backsize coat 14 and an optional presize coat 16. Overlaying the presize coat is a make coat 18 in which are embedded abrasive grains 20 such as silicon carbide or aluminum oxide. A size coat 22 has been placed over the make coat 18 and the abrasive grains 20. There is no clear line of demarcation between the backsize coat and the presize coat which meet in the interior of the cloth backing which is saturated as much as possible with the resins of these coats. The binder of the present invention can be used to form make coat 18, size coat 22, or both make coat 18 and size coat 22.

In FIG. 2 there is illustrated a coated abrasive generally indicated as 30 which is formed on a paper backing 32. Paper backing is treated with a backsize coat 34 and presize coat 36. The presize coat is overcoated with a make coat 38 in which are embedded abrasive grains 40. The abrasive grains 40 and make coat 38 are overcoated with a size coat 42 which aids in holding the abrasive grains 40 onto the backing during utilization and further may contain cutting aids. The binder of the present invention can be used to form make coat 38, size coat 42, or both make coat 38 and size coat 42.

The binder for the coated abrasive of this invention is formed from a blend comprising a radiation curable monomer and a thermally curable resin. The radiation curable monomer can be selected from the group consisting of (a) isocyanurate derivatives having at least one terminal or pendant acrylate group, (b) isocyanate derivatives having at least one terminal or pendant acrylate group, and (c) multifunctional acrylate monomers, preferably having an average of at least three pendant acrylate functional groups. As used herein, the term "acrylate" includes both acrylate and methacrylate.

The monomers of isocyanurate derivatives (a) can be represented by the following structure:

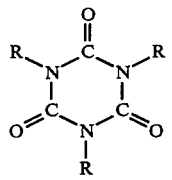

where each R can be the same or different and represents a group containing at least one terminal or pendant acrylate or methacrylate group. Preferably, R represents

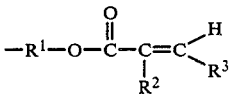

-continued

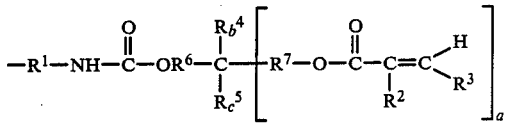

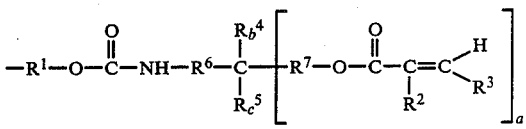

where $R^1$ represents a divalent alkylene group, preferably having from 1 to 20 carbon atoms, more preferably from 1 to 10 carbon atoms, $R^2$ represents —H or —$CH_3$ $R^3$ represents —H or —$CH_3$ $R^4$ represents hydrogen, an alkyl group, preferably having 1 to 20 carbon atoms, an arylalkyl group, preferably having 6 to 26 carbon atoms, $R^5$ represents hydrogen, an alkyl group, preferably having 1 to 20 carbon atoms, an arylalkyl group, preferably having 6 to 26 carbon atoms, $R^6$ represents a divalent alkylene group, preferably having from 1 to 20 carbon atoms, more preferably from 1 to 10 carbon atoms, $R^7$ represents a covalent bond or a divalent alkylene group, preferably having from 1 to 20 carbon atoms, more preferably 1 to 10 carbon atoms, a represents an integer from 1 to 3, inclusive, b represents 0 or 1, c represents 0 or 1, and $a+b+c=3$.

The moieties represented by $R^1$, $R^6$, $R^7$ can be straight chain, branched, or cyclic. If cyclic, the cyclic ring can contain 5 or 6 ring atoms.

Isocyanurate monomers suitable for the present invention can be prepared according to methods described in U.S. Pat. Nos. 3,932,401, 4,145,544, 4,288,586, 4,324,879, 4,485,226, all of which are incorporated herein by reference.

The monomers that are acyclic isocyanate derivatives (b) can be represented by the following structure:

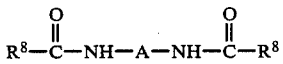

where

A represents a divalent alkylene group, preferably having from 1 to 20 carbon atoms, $R^8$ can be the same or different and represents

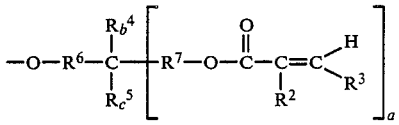

where a, b, c, $R^2$, $R^3$, $R^4$, $R^5$, $R^6$, $R^7$ are as defined above.

A can be straight chain, branched chain, or, if sufficiently long, cyclic. Because of availability of starting materials, A is preferably $-CH_2-C(CH_3)_2$
$-CH_2-CH(CH_3)-CH_2-CH_2-$ It is preferred that the monomers be in the heterocyclic ring configuration because polymers formed from them are more heat resistant, particularly under high temperature grinding conditions.

Multifunctional acrylates suitable for use in this invention have an average of at least three pendant acrylate functional groups. The preferred multifunctional acrylates are triacrylates due to their fast cure speeds, relatively low cost, availablity, and ease of handling. Multifunctional acrylates of this invention are preferably selected from trimethylolpropane triacrylate, glycerol triacylate, pentaerythritol triacrylate and methacrylate, pentaerythritol tetraacrylate and methacrylate, dipentaerythritol pentaacrylate, sorbitol triacrylate, and sorbital hexaacrylate.

The above-mentioned radiation curable monomer are not considered to be oligomers. Oligomers are very low molecular weight polymers in which the number of repeating units (n) equals 2 to 10, (See R.B. Seymour & C.E. Carraher, Jr., *Polymer Chemistry* 2nd Ed.). Oligomers are generally much more viscous than monomers. The increased viscosity generally makes the oligomer more difficult to apply during the manufacture of coated abrasives or nonwoven three dimensional abrasives products. To reduce the viscosity, solvent is added, giving rise to health hazards and the difficulty of removal. In view of these problems, monomers are more advantangeous in the manufacture of coated abrasive products than oligomers.

The thermally curable resins suitable for use in this invention are preferably selected from the group consisting of phenolic resins, urea-formaldehyde resins, melamine-formaldehyde resins, epoxy resins, acrylate resins, and polyimide resins. Other thermally curable resins suitable for this invention include isocyanate and isocyanurate. Phenolic resins are preferred because of their thermal properties, availability, cost, and ease of handling. There are two types of phenolic resins: resole and novolac. Resole phenolic resins are characterized by being alkaline catalyzed and having a ratio of formaldehyde to phenol of greater than or equal to one, typically from 1:1 to 3:1. Alkaline catalysts suitable for resole phenolic resins include sodium hydroxide, barium hydroxide, potassium hydroxide, calcium hydroxide, organic amines, or sodium carbonate. Resole phenolic resins are thermosetting resins and in the cured form exhibit excellent toughness, dimensional stability, high strength, hardness, and heat resistance. The above mentioned properties make a resole phenolic resin ideal as a binder for abrasive grains.

Novolac phenolic resins are characterized by being acid catalyzed and having a ratio of formaldehyde to phenol of less than one, typically between 0.5:1 to 0.8:1. Acidic catalysts suitable for novolac phenolic resins include sulfuric, hydrochloric, phosphoric, oxalic, and p-toluene sulfonic acids. Novolac phenolic resins are thermoplastic resins and in the cured form are brittle solids. Novolac phenolic resins are typically reacted with other chemicals to form a crosslinked solid.

Both the resole and novolac phenolic resins are thermally curable. The temperature and pH significantly affect the mechanism of polymerization and the final properties of the cured resin. Examples of commercially available phenolic resins include "Varcum" from BTL Specialty Resins Corp, "Aerofene" from Ashland Chemical Co., "Bakelite" from Union Carbide, and "Resinox" from Monsanto.

The 1,2-epoxide group-containing compounds that can be used in the binder of this invention have an oxirane ring, i.e.

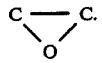

1,2-Epoxide group-containing compounds include monomeric epoxy compounds and polymeric epoxy compounds, and may vary greatly in the nature of their backbones and substituent groups. For example, the backbone may be selected from aliphatic, aromatic, cycloaliphatic, heterocyclic groups. If the backbone is aliphatic it may be a straight chain or a branched chain. Substituent groups thereon can be any group free of an active hydrogen atom, which is reactive with an oxirane ring at room temperature. Representative examples of acceptable substituent groups include halogens, ester groups, ether groups, sulfonate groups, siloxane groups, nitro groups, and phosphate groups. The molecular weight of the 1,2-epoxide group-containing compounds can vary from about 60 to about 4000, and preferably range from about 100 to about 600. Mixtures of various 1,2-epoxide group-containing compounds can be used in the compositions of this invention. The compound is polymerized by the ring opening. Catalysts that can initiate ring opening include: boron trifluoride, tertiary amines, compounds containing a reactive hydrogen atom such as organic acids, alcohols, mercaptans and primary and secondary amines. Cured 1,2-epoxide group-containing compounds are characterized by having excellent chemical resistance, good adhesion to substrates, dimensional stability and toughness.

Ethylenically-unsaturated compounds can optionally be added to the binder of this invention to modify the properties thereof. They include monomeric or polymeric compounds that contain atoms of carbon, hydrogen, and oxygen, and optionally, nitrogen and the halogens. OxYgen and nitrogen atoms are generally present in ether, ester, urethane, amide, and urea groups. The compounds preferably have a molecular weight of less than about 4000 and are preferably esters of aliphatic monohydroxy and polyhydroxy group-containing compounds and unsaturated carboxylic acids, such as acrylic acid, methacrylic acid, itaconic acid, crotonic acid, isocrotonic acid, maleic acid, and the like. Representative examples of ethylenically-unsaturated compounds preferred for this invention include methyl methacrylate, ethyl methacrylate, ethylene glycol diacrylate and methacrylate, 1,6-hexanediol diacrylate, triethylene glycol diacrylate and methacrylate, bisphenol A diacrylate, and ethoxylated bisphenol A diacrylate, 1,4-butanediol diitaconate, propylene glycol dicrotonate, dimethyl maleate, and the like. Other ethylenically-unsaturated compounds suitable for this invention include monoallyl, polyallyl, and polymethallyl esters and amides of carboxylic acids such as diallyl phthalate, diallyl adipate, and N,N-diallyladipamide. It is preferred that the ethylenically-unsaturated compounds be acrylic compounds because of their availability and high cure speed.

Aromatic and cyclic monomers having at least one functional group that can be polymerized via a free radical reaction can also be added to the binder of the present invention. In particular, this functional group can be either an acrylate functional group or a vinyl functional group. Aromatic monomers are known for their good thermal properties, which is desired for a binder for a coated abrasive. Examples of such aromatic and cylic monomers are vinyl toluene, styrene, divinylbenzene, 1,3,5-tri(2-methacryloxyethyl)-s-triazine, N-vinyl-2-pyrrolidone, and N-vinylpiperidone. Other monomers that can be added to the binder of the present invention include acrylamide methacrylamide, N-methylacrylamide, and N,N-dimethylacrylamide.

The ratio of radiation curable monomer to thermally curable resin, based on weight, can range from about 90:10 to about 10:90, preferably from about 15:85 to about 33:67.

The binder of the present invention can contain fillers, coupling agents, fibers, lubricants, and minor amounts of other additives such as surfactants, pigments, dyes, wetting agents, grinding aids, and suspending agents. The amounts of these materials are selected to give the properties desired.

The fillers can be selected from any filler material which does not adversely affect the bonding characteristics of the binder. Preferred fillers include calcium carbonate, calcium oxide, calcium metasilicate, aluminum sulfate, alumina trihydrate, cryolite, magnesia, kaolin, quartz, silica, and glass. Fillers that function as cutting aids are cryolite, potassium fluoroborate, feldspar, and sulfur. Fillers can be used in amounts up to about 250 parts by weight, preferably from about 30 to about 150 parts by weight, per 100 parts by weight of binder. At these loadings the cured binder will exhibit good flexibility and toughness.

The radiation curable monomers can be cured via electromagnetic radiation, such as ionizing radiation, ultraviolet radiation, or visible light radiation. As used herein, the term, "electromagnetic radiation" means non-particulate radiation having a wavelength within the range of 200 to 700 nanometers. The amount of radiation used depends upon the degree of cure desired. Ionizing radiation, e.g., electron beam radiation, preferably has an energy level of 0.1 to 15 Mrad, more preferably 1 to 10 Mrad. Ultraviolet radiation is non-particulate radiation having a wavelength within the range of 200 to 700 nanometers, more preferably between 250 to 400 nanometers. Visible light radiation is non-particulate radiation having a wavelength within the range of 400 to 800 nanometers, more preferably between 400 to 550 nanometers. The rate of curing with a given level of radiation varies according to the thickness of the binder coating as well as the density and nature of binder composition.

If the radiation curable monomer is cured via ultraviolet radiation, a photoinitiator is required to initiate free-radical polymerization. Examples of photoinitiators are organic peroxides, azo compounds, quinones, benzophenones, nitroso compounds, acyl halides, hydrazones, mercapto compounds, pyrylium compounds, triacylimidazoles, bisimidazoles, chloroalkytriazines, benzoin ethers, benzil ketals, thioxanthones, and acetophenone derivatives. Additional references to free-radical photoinitiator systems for ethylenically-unsaturated compounds are described in U.S. Pat. No. 3,887,450 (e.g., col. 4), U.S. Pat. No. 3,895,949 (e.g., col. 7), and U.S. Pat. No. 3,775, 113. Another good reference to free-radical photoinitiator systems is J. Kosar, *Light-Sensitive Systems*, J. Wiley and Sons, Inc. (1965), especially Chapter 5.

If the radiation curable monomer is cured via visible light radiation, a photoinitiator is required to initiate the free-radical polymerization. Examples of such photoinitiators can be found in U S. Pat. No. 4,735,632.

The ratio of the blend of thermally curable resin and the radiation curable monomer to the photoinitiator, based on weight, can range from about 95:5 to about 99.99 to 0.01.

A thermal free-radical initiator can optionally be added to the binder of the present invention. Examples of such thermal initiators are peroxides, e.g benzoyl peroxide, azo compounds, benzophenones, and quinones.

The binder can be used to treat the backing material, e.g., cloth, paper, or plastic sheeting, to saturate or provide a back or front coat thereto, to provide a make coat by which abrasive granules are initially anchored, or to provide a size or reinforcing coat for binding abrasive granules to the backing material.

The advantage of this invention over the prior art is the reduction in cost of the binder by mixing the expensive radiation curable monomer with the less expensive thermally curable resin and by elimination of the festoon oven. The coated abrasive product of this invention has improved abrading performance with respect to severe grinding conditions as compared with coated abrasives having radiation curable binders heretofore known.

When coated abrasive products containing phenolic resin are used under wet conditions, the phenolic resin softens because of its moisture sensitivity. Consequently, the performance of coated abrasive under wet conditions is reduced. However, the present invention overcomes this problem by blending radiation curable monomer with thermally curable phenolic resins. An abrasive product utilizing the resin system of this invention has improved water resistance as compared with a 100% phenolic resin, and, as a consequence, improved grinding performance under wet conditions.

In the manufacture of a coated abrasive product, the binder of this invention can be used as a treatment coat for the backing, as a make coat for abrasive grains, as a size coat for abrasive grains, or for any combination of the aforementioned coats. In addition, the binder of this invention can be used in coated abrasive embodiments where only a single-coat binder is employed, i.e., where a single-coat takes the place of a make coat/size coat combination. The binder of the present invention can be applied to the backing in one or more treatment steps to form a treatment coat. The treatment coat can be cured by a source of radiation, and can optionally be further cured by a drum cure; there is no need to festoon cure the backing in order to set the treatment coat or coats. It is preferable to cure the treatment coat or coats via the radiation source only. After the backing has been properly treated with a treatment coat, the make coat can be applied. After the make coat is applied, the abrasive grains are applied over the make coat. Next, the make coat, now bearing abrasive grains, is exposed to a radiation source, and, optionally, to heat by means of a drum cure, which generally solidifies or sets the binder sufficiently to hold the abrasive grains to the backing. It is preferable to use only the radiation source to set the make coat. Then the size coat is applied, and the size coat/abrasive grain/make coat combination is exposed to a radiation source and to a heat source, preferably via a drum cure. This process will substantially cure or set the make and size coat used in the coated abrasive constructions.

Exposure to a heat source is mandatory after application of the size coat. The coating weights of the binder of the present invention are similar to the coating weights of binders of conventional coated abrasives. The binder of the present invention only needs to be in at least one of the binder layers, i.e., treatment coat, make coat, size coat, comprising the coated abrasive product. It does not need to be in every binder layer; the other binder layers can utilize various other resinous systems known in the art. If the binder system of the present invention is in more than one layer, the radiation source does not need to be the same for curing each layer of the coated abrasive.

It is also contemplated that the binder of the present invention can be employed as a binder for non-woven abrasive products. Non-woven abrasive products typically include an open, porous, lofty, polymeric filament structure having abrasive grains distributed throughout the structure and adherently bonded therein by an adhesive or resin. The method of making such non-woven abrasive products is well known in the art.

The backing, as previously mentioned, can be formed of paper, cloth, vulcanized fiber, polymeric film, or any other backing material suitable for use in coated abrasives, or treated versions of the foregoing. The abrasive grains can be of any conventional grade utilized in the formation of coated abrasives and can be formed of flint, garnet, aluminum oxide, ceramic aluminum oxide, alumina zirconia, diamond, silicon carbide, and multigrain granules etc., or mixtures thereof. The abrasive grains can be oriented or can be applied to the backing without orientation, depending upon the requirements of the particular coated abrasive product The frequency, i.e., coating density, of the abrasive grains on the sheet is also conventional.

The coated abrasive product of the invention can also be modified, by means that are known in the art. For example, a back coating such as pressure-sensitive adhesive can be applied to the nonabrasive side of the backing, and various supersizes, such as zinc stearate, can be applied to the abrasive surface to prevent abrasive loading. The supersize can contain a grinding aid to enhance the abrading characteristics of the coated abrasive.

The coated abrasives of this invention do not need to use the binder formed from the blend comprising the radiation curable monomer and thermally curable resin in all of the coats or treatments thereof, so long as at least one of the make coat, size coat, or a treatment coat of the coated abrasive uses the aforementioned binder. For the other coats or treatments not using that binder, examples of other suitable binders include glue, varnish, epoxy resins, phenolic resins, and polyurethane resins.

The following non-limiting examples will further illustrate the invention. All coating weights are in grams/square meter, unless otherwise specified. All resin formulation ratios and percentages are based upon weight. The stock removal of the coated abrasive products tested below represent an average of at least two belts. The experimental error of the grinding tests were ± 8%.

The following components were used to fabricate the coated abrasive products of the examples.

YW1: WOVEN Y WEIGHT POLYESTER/NYLON BACKING

This was a Y weight woven polyester/nylon cloth with a four over one weave. The backing was saturated with a phenolic/latex resin and then placed in an oven to partially cure the resin. Then a latex/phenolic resin and calcium carbonate solution was applied to the backside of the backing and heated to partially cure the resin. Finally, a latex/phenolic resin was applied to the front side of the cloth and heated to partially cure the resin. The backing was completely treated and was ready to receive the make coat.

YW2: WOVEN Y WEIGHT POLYESTER BACKING

This was a Y weight woven polyester backing with a four over one weave. The treatments were very similar to the YW1 backing described above. After the backing was completely treated, it was ready to receive the make coat.

XW1: WOVEN X WEIGHT COTTON BACKING

This was a X weight woven cotton backing with a two over one weave. The backing had a saturant treatment and a backsize treatment.

TP1: TEST PROCEDURE ONE

Endless abrasive belts (7.6 cm × 335 cm) were tested on a constant load plunge grinder by abrading a 1.91 cm diameter face of a 1095 tool steel rod with ten successive ten-second grinding passes, weighing and cooling the rod after each pass. The pressure was 150 psi and belt speed was 2250 m/min. The experimental error on this test is ± 10%.

TP2: TEST PROCEDURE TWO

Endless abrasive belts (7.6 cm × 335 cm) were tested on a constant rate plunge grinder by abrading a 1.91 cm diameter face of a 1095 tool steel rod at a rate of 5 seconds/rod until the coated abrasive shelled, i.e. a substantial amount of the abrasive grit came off of the backing. The belt speed was 2250 m/min. The experimental error on this test is ± 10%.

TP3: TEST PROCEDURE THREE

Endless abrasive belts (7.6 cm × 335 cm) were tested on a constant load surface grinder. A pre-weighed, 4150 mild steel workpiece approximately 2.5 cm × 5 cm × 18 cm, mounted in a holder, was positioned vertically, with the 2.5 cm × 18 cm face facing an approximately 36-cm diameter 85 Shore A durometer serrated rubber contact wheel with one on one lands over which was entrained the coated abrasive belt. The workpiece was then reciprocated vertically through a 18-cm path at the rate of 20 cycles per minute, while a spring-loaded plunger urged the workpiece against the belt with a load of 13.6 kg as the belt was driven at about 2050 meters per minute. After one minute elapsed grinding time, the workpiece-holder assembly was removed and reweighed, the amount of stock removed calculated by subtracting the abraded weight from the original weight, and a new, pre-weighed workpiece and holder were mounted on the equipment. The experimental error on this test is ± 5%.

In the subsequent examples, the following abbreviations and designations are used:

| | |
|---|---|
| TMPTA | Trimethylol propane triacrylate |
| TATHEIC | Triacrylate of tris(hydroxy ethyl) isocyanurate |
| NVP | N-vinyl-2-pyrrolidone |
| TEGDMA | Triethyleneglycol dimethacrylate |
| PH1 | 2,2-dimethoxy-1,2-diphenyl-1-ethanone |
| Wollastokup ® filler | an amino silane treated calcium metasilicate filler available from NYCO Company |

COMPARATIVE EXAMPLE A

A coated abrasive prepared using a phenolic resin make coat and a phenolic resin size coat was designated as Comparative Example A. The backing of the coated abrasive was YW1. A make coat binder consisting of 48% resole phenolic resin and 52% calcium carbonate was prepared. A solvent [90/10 ratio of water to ethyl cellosolve i.e., $C_2H_5O(CH_2)_2OH$] was added to the make coat binder to form an 84% solids dispersion. The ethyl cellosolve/water solvent was used in all examples reported herein, unless otherwise specified. The dispersion for the make coat was applied to the backing at an average wet weight of 240 g/m$^2$. Immediately after application of the make coat, grade 50 ceramic aluminum oxide abrasive grains (Cubitron ® grains, available from Minnesota Mining and Manufacturing Company, St. Paul, Minn.) were applied, at a weight of 612 g/m$^2$. The backing/make coat/abrasive grain composite was heated in a festoon oven and precured for 90 minutes at 88° C. A size coat binder consisting of 32% by weight resole phenolic resin and 68% by weight cryolite was prepared. The size coat binder was diluted with solvent to form an 82% solids dispersion. The dispersion for the size coat was applied at an average wet weight of 285 g/m$^2$. After application of the size coat, the resulting coated abrasive was heated in a festoon oven and precured for 90 minutes at 88° C., final cured for 10 hours at 100° C. The coated abrasive material was flexed and converted into endless belts. These belts were tested for abrasiveness following the test procedure designated above as TP1. The test results are set forth in Table I.

EXAMPLE 1

The coated abrasive of this example used a make coat binder and a size coat binder of the present invention The backing of the coated abrasive was YW1. The make coat binder was applied by way of a dispersion consisting of 30.5% resole phenolic resin, 10.6% TMPTA, 1% PH1, 5.9% isopropanol, 42.3% calcium carbonate, and 9.7% solvent. The weights of make coat, abrasive grain coat, and size coat, and the material of the abrasive grains, were the same as were used in Example 1. After the dispersion for the make coat and abrasive grains were applied to the backing, the resulting composite was irradiated with two ultraviolet lamps, each operating at 120 watts/cm at 3.7 meters/minute. Next, the size coat binder was applied by way of a dispersion consisting of 20.2% resole phenolic resin, 5% TMPTA, 1% PH1, 11.6% isopropanol, 55.8% cryolite, and 6.4% solvent. The resulting composite was irradiated with two ultraviolet lamps, each operating at 120 watts/cm at 5.6 meters/minute. Next, the coated abrasive material was precured in a convection oven and final cured in a conventional drum oven. Thus, in this example, there was no festoon curing. The coated abrasive was flexed, converted into endless belts and tested under the same conditions as were used in Comparative Example A. The results are set forth in Table I.

EXAMPLE 2

The coated abrasive of this example used the binder of Example 1 as the make coat and the conventional resole phenolic resin described in Comparative Example A as the size coat. The backing of the coated abrasive was YW1. The make coat and abrasive grains were applied to the backing and the make coat cured in the same manner as was used in Example 1. The size coat was applied and cured in the same manner as was used in Comparative Example A. The coated abrasive was flexed, converted into endless belts, and tested under the same conditions as were used in Comparative Example A. The results are set forth in Table I.

EXAMPLE 3

The coated abrasive of this example used the conventional resole phenolic resin described in Comparative Example A as the make coat and the size coat binder of Example 1 as the size coat. The backing of the coated abrasive was YW1. The make coat and abrasive grains were applied to the backing and make coat cured in the same manner as was used in Comparative Example A. The size coat was applied and cured in the same manner as was used in Example 1. The coated abrasive was flexed, converted into endless belts, and tested under the same conditions as were used in Comparative Example A. The results are set forth in Table I.

TABLE I

| Example no. | Make coat binder | Size coat binder | Total cut (% of control) |
|---|---|---|---|
| A (Comparative) | Phenolic | Phenolic | 100 |
| 1 | Blend | Blend | 96 |
| 2 | Blend | Phenolic | 93 |
| 3 | Phenolic | Blend | 95 |

The total cut was within experimental error for all of the belts, and there was essentially no significant difference in performance. These results indicated that a blend of radiation curable resins and phenolic resin can be utilized in a coated abrasive without the need for festoon curing.

EXAMPLE 4

The make coat for the coated abrasive of this example was applied by way of a dispersion consisting 31.3% resole phenolic resin, 16.5% TATHEIC, 1% PH1, 45.8% Wollastokup ® filler, and 5.4% solvent. Immediately after the dispersion for the make coat was applied to a YW2 backing, grade 50 aluminum oxide abrasive grains were applied onto the make coat. The weight of the make coat was 240 g/m$^2$ and the weight of abrasive grain coat was 612 g/m$^2$. The resulting composite was irradiated at 6.1 meters/minute in a nitrogen atmosphere with seven ultraviolet lamps operating at 120 watts/cm. The resulting coated abrasive was then wound into a jumbo roll and cured for 90 minutes at 88° C. Next, the size coat binder, which consisted of 48% resole phenolic resin and 52% Wollastokup ® filler, was prepared. The size coat binder was diluted to 78% solids, and the resulting dispersion was applied so as to give an average weight of 240 g/m$^2$. The resulting coated abrasive was festoon cured, which involved a precure for 90 minutes at 88° C. followed by a final cure for 10 hours at 100° C. The product was flexed and converted into endless belts. These belts were tested for abrasiveness by the test procedure designated TP1. The test results are set forth in Table II.

EXAMPLE 5

The coated abrasive of Example 5 was prepared and tested in the same manner as were those of Example 4 except that the abrasive of Example 5 did not utilize a thermal precure of the make coat. The test results are set forth in Table II.

TABLE II

| Example no. | Cut (grams of steel removed) |
|---|---|
| 4 (drum precure of the make coat) | 544 |
| 5 (no drum precure of the make coat) | 549 |

There was essentially no difference in performance between the abrasives of the two examples. The abrasive of Example 5 is preferred because it eliminates a processing step.

COMPARATIVE EXAMPLE B

A make coat binder, which consisted of 48% resole phenolic resin and 52% Wollastokup ® filler, was prepared. This composition was diluted with solvent to form a 84% solids dispersion, which was then applied to a YW2 backing at a weight of 240 g/m$^2$. Grade 50 aluminum oxide abrasive grains were then electrostatically coated onto the make coat at an average weight of 605 g/m$^2$. The resulting composite was festoon cured for 90 minutes in an oven set at 88° C. Next, the size coat binder, which was identical to the make coat binder, except that the size coat binder was diluted with solvent to 78% solids, was applied at an average weight of 270 g/m$^2$. The resulting composite was festoon cured for 90 minutes in an oven at 88° C. Then the composite received a final cure for 10 hours at 100° C. Next, the coated abrasive was flexed, tested, and converted into endless belts. The belts were tested according to TP2 and the results are set forth in Table III.

EXAMPLE 6

The procedure for making the coated abrasive of this example was identical to that of Example 4, except that a high temperature drum cure was utilized in addition to the final cure. The duration of the high temperature drum cure was 4 hours at a temperature of 138° C. The coated abrasive was then flexed, converted into endless belts, and tested under the same conditions as was used in Comparative Example B. The results are set forth in Table III.

TABLE III

| Example no. | Total cut (% of Control) |
|---|---|
| B (Comparative) | 100 |
| 6 | 181 |

A significantly large performance increase was achieved using the binder of the present invention as a make coat and a conventional phenolic resin as a size coat.

COMPARATIVE EXAMPLE C

This example used a conventional phenolic/latex resin cloth treatment. The treatments were essentially identical to those described for the preparation of YW2. Conventional phenolic resin compositions were used for the make and size coat in the constructions. The abrasive grains were grade 36 aluminum oxide. The make coat, abrasive grains, and size coat were applied to the backing and cured according to conventional methods. The coated abrasive was flexed, converted into endless belts, and tested for abrasiveness. The test procedure is designated TP1, and the test results are set forth in Table IV.

EXAMPLE 7

This example used the binder of the present invention as a cloth treatment. A presize consisting of 59.1% resole phenolic resin, 19.7% TEGDMA, 19.7% TATHEIC, and 1.5% PH1 was prepared. The presize was applied to the front side of greige cloth at an average weight of 130 g/m$^2$. The cloth was then exposed to four ultraviolet lamps operating at 120 watts/cm at 7.6 meters/minute. Next, a backsize composition consisting of 29.5% resole phenolic resin, 9.8% TEGDMA, 9.8% TATHEIC, 1.5% PH1 and 4.94% calcium carbonate filler was prepared. The backsize composition was applied at a weight of 130 g/m$^2$. The cloth was then exposed to four ultraviolet lamps operating at 120 watts/cm at 7.6 meters/minute. No thermal cure was used to treat the cloth, even though the composition for the cloth treatment contained a substantial amount of phenolic resin. The remaining steps in producing and testing the coated abrasive were the same as were used in Comparative Example C. The test results are set forth in Table IV.

TABLE IV

| Example no. | Stock removal (% of control) |
|---|---|
| C (Comparative) | 100 |
| 7 | 98 |

The binder of the present invention provided essentially the same performance as 100% phenolic cloth treatment. However, the binder of the present invention eliminated the need for thermal curing, and only two cloth treatments were required instead of three treatments required with the conventional phenolic composition.

The following examples illustrate the effect of varying the ratio of thermally curable resin to radiation curable resin. The backing in these examples was XW1.

COMPARATIVE EXAMPLE D

A make coat binder consisting of 48% resole phenolic resin and 52% calcium carbonate was prepared. The binder was diluted with solvent to 84% solids and was coated onto the backing at a weight of 270 g/m$^2$. Grade 50 ceramic aluminum oxide abrasive grains were applied over the make coat at a weight of 615 g/m$^2$. The resulting composite was precured in an oven for 90 minutes at 88° C. A size coat binder consisting of 32% resole phenolic resin, 2% iron oxide, and 66% cryolite was prepared. This binder was diluted with solvent to 76% solids and coated at a weight of 295 g/m$^2$. The resulting composite was precured for 90 minutes at 88° C., and then final cured for 10 hours at 100° C. The coated abrasive was then flexed, converted into endless belts, and tested under the test procedure TP3. The results are set forth in Table V.

EXAMPLE 8

A composition for the make coat consisting of 35.9% resole phenolic resin, 5.4% TMPTA, 5.4% TATHEIC, 1.3% PH1, and 52% calcium carbonate was prepared. This composition was then diluted with solvent to 84% solids and coated onto the backing at a weight of 270 g/m$^2$. Grade 50 ceramic aluminum oxide abrasive grains were applied over the make coat at a weight of 615 g/m$^2$. The resulting composite was exposed to ultraviolet light operating at 120 watts/cm at 24 cm/min. The composite was precured in an oven for 90 minutes at 88° C. The remaining steps were the same as in Comparative Example D. The results are set forth in Table V.

EXAMPLE 9

A composition for the make coat consisting of 30.9% resole phenolic resin, 7.8% TMPTA, 7.8% TATHEIC, 1.5% PH1, and 52% calcium carbonate was prepared. The remaining Steps were the same as in Example 8. The results are set forth in Table V.

EXAMPLE 10

A composition for the make coat consisting of 23.3% resole phenolic resin, 11.6% TMPTA, 11.6% TATHEIC 1.5% PH1, and 52% calcium carbonate was prepared. The remaining steps were the same as in Example 8. The results are set forth in Table V.

EXAMPLE 11

A composition for the make coat consisting of 15.5% resole phenolic resin, 15.5% TMPTA, 15.5% TATHEIC, 1.5% PH1, and 52% calcium carbonate was prepared. The remaining steps were the same as in Example 8. The results are set forth in Table V.

EXAMPLE 12

A composition for the make coat consisting of 7.8% resole phenolic resin, 19.35% TMPTA, 19.35% TATHEIC, 1.5% PH1 and 52% calcium carbonate was prepared. The remaining steps were the same as in Example 8. The results are set forth in Table V.

EXAMPLE 13

A composition for the make coat consisting of 23.25% TMPTA, 23.25% TATHEIC, 1.5% PH1 and 52% calcium carbonate was prepared. The remaining the steps were the same as in Example 8. The results are set forth in Table V.

TABLE V

| Example no. | Proportion thermally curable (%) | Proportion radiation curable (%) | Total cut (% of control) |
|---|---|---|---|
| D (Comparative) | 100 | 0 | 100 |
| 8 | 83 | 17 | 99 |
| 9 | 67 | 33 | 96 |
| 10 | 50 | 50 | 92 |
| 11 | 33 | 67 | 91 |
| 12 | 17 | 83 | 85 |
| 13 | 0 | 100 | 86 |

All of the foregoing examples illustrate useful coated abrasives. However the preferred compositions range from about 33% thermally curable resin to 67% radiation curable resin to from about 85% heat curable resin to about 15% radiation curable resin.

EXAMPLES 14 AND 15

These examples compare the performance of a coated abrasive utilizing an acrylated epoxy/phenolic binder with a coated abrasive utilizing an acrylated isocyanurate/phenolic binder.

COMPARATIVE EXAMPLE E

The coated abrasive of this example used an acrylated epoxy/phenolic resin as the make coat and a conventional phenolic resin as the size coat. The backing of the coated abrasive was YW2. The make coat binder consisted of 194 g of an acrylated epoxy ("Novacure"3703, Interez), 92 g of an acrylated epoxy resin (RDX 80827, Interez), 23 g of tetraethylene glycol diacrylate, 330 g of a resole phenolic resin (CR-3575, Clark Chemical Co.), 103 g of NVP, 19.4 g of tetraethylene glycol acrylate, 233 g of calcium carbonate filler, 0.5 g of a surfactant (FC-430, Minnesota Mining and Manufacturing Company), 0.5 g of a surfactant ("Modaflow", Monsanto Co.), 1.5 g of a surfactant (W-980, BYK Chemie), and 4.8 g of a black (PDI-1800, Pigment Dispersions Inc.). This formulation contained approximately 44% by weight radiation curable resins, 33% by weight phenolic resin, and 23% by weight filler. The make coat binder was applied to the backing at an average wet weight of 230 g/m$^2$. Grade 50 heat treated aluminum oxide abrasive grains were applied over the make coat at a weight of 612 g/m$^2$. The backing/make coat/abrasive grain composite was exposed to an electron beam at 6 meters/minute, 600 Kev and 5 megarads to partially cure the make coat. The size coat binder consisted of 48% by weight resole phenolic resin and 52% by weight calcium carbonate. The size coat binder was diluted with solvent to 78% solids. The size coat composition was applied at an average wet weight of 240 g/m$^2$. After the size coat was applied, the resulting material was festoon cured in an oven and precured for 90 minutes at 88° C. and final cured for 10 hours at 100° C. The coated abrasive material was flexed and converted into endless belts. These belts were tested for abrasiveness by the test procedure designated TP2. The test results are set forth in Table VI.

EXAMPLE 14

A coated abrasive using a TATHEIC/phenolic blend as the make coat and a conventional phenolic resin as the size coat was prepared. The backing of the coated abrasive was YW2. The make coat binder consisted of 433 g of TATHEIC, 333 g of a resole phenolic resin, and 230 g of calcium carbonate filler. The remaining steps to prepare and test the coated abrasive were the same as in Comparative Example E. The test results are set forth in Table VI.

EXAMPLE 15

A coated abrasive using a TATHEIC/phenolic blend as the make coat and a conventional phenolic resin as the size coat was prepared. The backing of the coated abrasive was YW2. The dispersion for the make coat consisted of 169 g of TATHEIC, 334 g of a resole phenolic resin, 40 g of solvent, and 458 g of calcium carbonate filler. The remaining steps to prepare and test the coated abrasive were the same as in Comparative Example E, except the electron beam curing condition was 10 megarads instead of 5 megarads. The test results are set forth in Table VI.

TABLE VI

| Example no. | Total cut (% of control) |
|---|---|
| E (Comparative) | 100 |
| 14 | 153 |
| 15 | 470 |

As evidenced from the above data, a significant performance increase was achieved utilizing the acrylated isocyanurate/phenolic blend, especially at the higher ratios of phenolic in comparison to the acrylated epoxy/phenolic blend.

Various modifications and alterations of this invention will become apparent to those skilled in the art without departing from the scope and spirit of this invention, and should be understood that this invention is not to be unduly limited to the illustrated embodiments set forth herein.

What is claimed is:

1. An abrasive article comprising a backing and abrasive grains, wherein said abrasive grains are secured to at least one side of said backing by at least one binder prepared from a blend comprising (1) at least one radiation curable monomer selected from the group consisting of:
  (a) isocyanurate derivatives having at least one terminal or pendant acrylate group,
  (b) isocyanate derivatives having at least one terminal or pendant acrylate group, and
  (c) multifunctional acrylates having on average at least three pendant acrylate groups, and (2) a thermally curable resin selected from the group consisting of phenolic resins, epoxy resins having an oxirane ring, urea-formaldehyde resins, melamine-formaldehyde resins, and polyimide resins.

2. The article of claim 1 wherein said phenolic resin is a resole phenolic resin.

3. The article of claim 1 wherein said isocyanurate derivative monomer is represented by the formula:

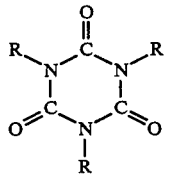

where each R can be the same or different and represents a group containing at least one terminal or pendant acrylate or methacrylate group.

4. The article of claim 3 where R is selected from the group consisting of:

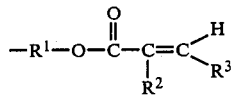

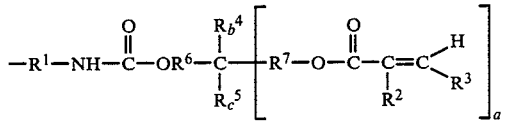

-continued

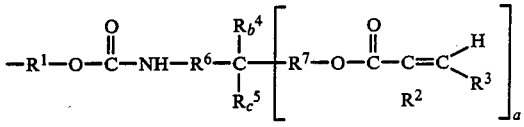

where $R^1$ represents a divalent alkylene group, $R^2$ represents —H or —$CH_3$, $R^3$ represents —H or —$CH_3$, $R^4$ represents hydrogen, an alkyl group, or an arylalkyl group, $R^5$ represents hydrogen, an alkyl group, an or arylalkyl group, $R^6$ represents a divalent alkylene group, $R^7$ represents a covalent bond or a divalent alkylene group, a represents an integer from 1 to 3, inclusive, b represents 0 or 1, c represents 0 or 1, and a + b + c = 3.

5. The article of claim 1 wherein said acrylate monomer is represented by the formula:

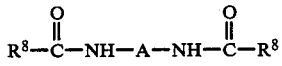

where A represents a divalent alkylene group, and can be the same or different, and $R^8$ represents:

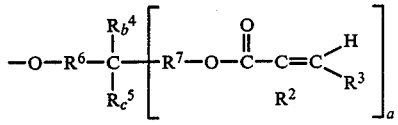

where $R^1$ represents a divalent alkylene group, $R^2$ represents —H or —$CH_3$, $R^3$ represents —H or —$CH_3$, $R^4$ represents hydrogen, an alkyl group, or an arylalkyl group, $R^5$ represents hydrogen, an alkyl group, an or arylalkyl group, $R^6$ represents a divalent alkylene group, $R^7$ represents a covalent bond or a divalent alkylene group, a represents an integer from 1 to 3, inclusive, b represents 0 or 1, c represents 0 or 1, and a + b + c = 3.

6. The article of claim 5 wherein said acrylate monomer is selected from the group consisting of trimethylol propane triacrylate and pentaerythritol triacrylate.

7. The article of claim 1 wherein said binder further comprises a thermal curing catalyst.

8. The article of claim 1 wherein said binder further comprises a member selected from the group consisting of fillers, coupling agents, surfactants, wetting agents, dyes, pigments, and grinding aids.

9. The article of claim 8 wherein said filler can be use in an amount up to 250 parts by weight per 100 parts by weight of said binder.

10. The article of claim 8 wherein said filler is selected from the group of calcium carbonate, silica, calcium metasilicate, alumina trihydrate, and feldspar.

11. The article of claim 1 wherein said binder further comprises an ethYlenically unsaturated compound.

12. The article of claim 11 wherein said ethylenically unsaturated compound is selected from the group consisting of ethylene glycol diacrylate, diacrylate of bisphenol A, ethoxylated diacrylate of bisphenol A, stryene, aliphatic urethane acrYlate, N-vinyl-2-pyrrolidone, divinylbenezene, and 1,6-hexanediol diacrylate.

13. The article of claim 1 wherein said binder further comprises a photoinitiator.

14. The article of claim 13 wherein the ratio of the blend of thermally curable resin and the radiation curable monomer to said photoinitiator, based on weight, ranges from about 95:5 to 99.99:0.01.

15. The article of claim 1 wherein the ratio of the thermally curable resin to the radiation curable monomer, based on weight, ranges from about 90:10 to 10:90.

16. The article of claim 1 wherein the ratio of the thermally curable resin to the radiation curable monomer, based on weight, ranges from about 15:85 to 33.67.

17. The article of claim 1 wherein said abrasive article is a coated abrasive.

18. A coated abrasive article comprising a backing, a make coat, abrasive grains, and a size coat, wherein at least one of said make coat or size coat comprises a binder prepared from a blend comprising (1) at least one radiation curable monomer selected from the group consisting of:
  (a) isocyanurate derivatives having at least one terminal or pendant acrylate group,
  (b) isocyanate derivatives having at least one terminal or pendant acrylate group or
  (c) multifunctional acrylates having on average at least three pendant acrylate groups, and
(2) a thermally curable resin selected from the group consisting of phenolic resins, epoxy resins having an oxirane ring, urea-formaldehyde resins, melamine-formaldehyde resins, and polyimide resins.

19. A coated abrasive article comprising a backing, a backing treatment or treatments, a make coat, abrasive grains, and a size coat, wherein at least one of said backing treatment or treatments, make coat, or size coat comprises a binder prepared from a blend comprising (1) at least one radiation curable monomer selected from the group consisting of:
  (a) isocyanurate derivatives having at least one terminal or pendant acrylate group,
  (b) isocyanate derivatives having at least one terminal or pendant acrylate group or
  (c) multifunctional acrylates having on average at least three pendant acrylate groups, and
(2) a thermally curable resin selected from the group consisting of phenolic resins, epoxy resins having an oxirane ring, urea-formaldehyde resins, melamine-formaldehyde resins, and polyimide resins.

20. The coated abrasive of claim 19 wherein said backing treatment or treatments comprise a binder prepared from a blend comprising said thermally curable resin and said at least one radiation curable monomer and one of said make and size coats comprise a binder selected from the group consisting of glue, varnish, epoxy resin, phenolic resin, and polyurethane resin.

21. The article of claim 1 wherein said abrasive article is a nonwoven abrasive article.

22. The article of claim 1 wherein said thermally curable resin is a phenolic resin.

23. The article of claim 18 wherein said thermally curable resin is a phenolic resin.

24. The article of claim 19 wherein said thermally curable resin is a phenolic resin.

* * * * *